US005664390A

United States Patent [19]

Sorkin

[11] Patent Number: 5,664,390

[45] Date of Patent: Sep. 9, 1997

[54] BOLSTER FOR USE IN CONSTRUCTION

[76] Inventor: Felix L. Sorkin, 4115B Greenbriar Dr., P.O. Box 1503, Stafford, Tex. 77477

[21] Appl. No.: 562,990

[22] Filed: Nov. 27, 1995

[51] Int. Cl.[6] ..... E04C 5/16

[52] U.S. Cl. ..... 52/687; 52/677; 52/686; 52/688; 52/689

[58] Field of Search ..... 52/687, 689, 685, 52/686, 688, 677, 681; 403/135

[56] References Cited

U.S. PATENT DOCUMENTS

| | | | |
|---|---|---|---|
| 3,830,032 | 8/1974 | Robb | 52/687 |
| 4,000,591 | 1/1977 | Courtois | 52/689 |
| 4,942,714 | 7/1990 | Langley, Jr. et al. | 52/687 |
| 5,555,693 | 9/1996 | Sorkin | 52/687 X |

OTHER PUBLICATIONS

Conas Brochure, "Semifix—Beam Bolsters" and U-Fix—Slab Bolsters, circa 1993, p. 4.

*Primary Examiner*—Wynn E. Wood
*Assistant Examiner*—W. Glenn Edwards

[57] ABSTRACT

A bolster for use in construction including a plurality of leg members arranged in parallel relationship and a beam integrally formed with the plurality of leg members and extending across the plurality of leg members. Each of the plurality of leg members has a foot for contacting an underlying surface. Each of the leg members includes a central body portion, a first leg extending downwardly from one side of the central body portion and a second leg extending downwardly from an opposite side of the central body portion. The foot is formed at an end of each of the first and second legs opposite the central body portion. The foot includes a plurality of pin-like projections extending outwardly from a bottom surface thereof. The beam has a waveform pattern formed across a top surface of the beam and a rectangular cross-section in a plane parallel to the plurality of leg members. The beam includes a male connector formed at one end and a female connector formed at an opposite end for receipt within a connector of an adjacent bolster.

13 Claims, 1 Drawing Sheet

BOLSTER FOR USE IN CONSTRUCTION

TECHNICAL FIELD

The present invention relates generally to bolsters, chairs, and spacers that are used in construction activities for the support of post-tension cables, rebars, or mesh. More particularly, the present invention relates to bolsters which are preformed for the support of rebars in deck construction activities.

BACKGROUND ART

Bolsters are commonly used in the construction industry for the support of post-tension cables, rebars, or mesh above a surface. Typically, when such materials are used, they must be supported above the surface when the concrete is poured. These bolsters are used with poured decks. In normal use, the bolster is positioned on the deck and includes a beam which extends across a plurality of leg members. This beam is formed so as to contact and support the rebar while the base of the bolster rests on the deck or on a grade. When the concrete is poured, the bolster will support the rebar a proper distance above the bottom surface.

In normal use, such bolsters are preformed so that they can be installed quickly and easily upon the deck. Conventionally, the preformed bolster will have a plurality of leg members and a steel rod welded to a top surface of each of the leg members. The rod will serve as a receiving area for the rebar. Conventionally, these bolsters are formed in preset lengths. If it is necessary to extend the bolster across a long surface of the deck, then the ends of the beams of adjacent bolsters will be wired together such that the bolsters are in an end-to-end relationship.

The most common bolster that is employed is a metal bolster manufactured by Meadow Steel Products of Tampa, Fla. This bolster has a plurality of inverted U-shaped leg members having outwardly extending foot portions. A rigid tubular rod having a slight waveform pattern formed thereon is welded to the middle of the inverted U-shaped leg members. Each of the leg members is generally arranged in parallel relationship to each other. The feet of each of the leg members will rest on the deck while the rebar is supported. After the concrete has solidified, and the deck is removed, the bottom surfaces of the feet will be exposed. As such, it is necessary to coat the feet with an anti-rust material. Alternatively, stainless steel material can be employed for the leg members and their associated feet.

Corrosion and cost are major problems affecting the bolster of Meadow Steel Products. In order to form such a bolster, a great deal of manufacturing must take place, including metal forming, bending, dipping, and welding. These activities, along with the cost of the material used to form the bolster, make the cost of the bolster relatively expensive. If the bolster is not coated or made of a stainless steel material, then corrosion can adversely affect the product. This corrosion can even occur when the metal is coated.

In the past, various attempts have been made to create bolsters of plastic material that can serve the purposes of the bolster of Meadow Steel Products. In general, such efforts have resulted in plastic chairs that are ineffective, cumbersome to use, or unable to properly withstand the forces imparted by the rebar upon the bolster. One such plastic bolster, manufactured by Conac, includes a central beam which is integrally formed with a plurality of leg members. Each of the leg members extends downwardly so as to present a flat surface to the underlying deck. No feet are provided which allow the bolster to be stapled to the deck.

Additionally, the configuration of this Conac bolster allows for easy deformation. It is very difficult and time consuming to join lengths of the Conac bolster together. The Conac bolster also lacks the suitable wave form pattern for the receipt of the rebar on the top surface of the bolster. This plastic bolster is often broken, collapsed, or tipped over in actual use. The base of such a bolster has only a very small area of contact with the deck. As such, these plastic bolsters lack the strength and ability to withstand the loads imparted to them.

It is an object of the present invention to provide a bolster that is corrosion-proof and relatively inexpensive.

It is another object of the present invention to provide a bolster that can be easily connected in end-to-end relationship.

It is a further object of the present invention to provide a bolster that withstands the forces imparted on it.

It is still another object of the present invention to provide a bolster that facilitates the ability to staple the bolster to the deck.

It is still another object of the present invention to provide a bolster that is easy to manufacture and easy to use.

These and other objects and advantages of the present invention will become apparent from a reading of the attached specification and appended claims.

SUMMARY OF THE INVENTION

The present invention is a bolster for use in construction that comprises a plurality of leg members arranged in parallel spaced relationship and s beam which is integrally formed with the plurality of leg members.

Each of the plurality of leg members has a foot means extending outwardly therefrom for contacting an underlying surface. The beam extends transversely across the plurality of leg members. Each of the leg members includes a central body portion, a first leg extending downwardly from one side of the central body portion, and a second leg extending downwardly from an opposite side of the central body portion. The foot is formed at an end of each of the first and second legs opposite the central body portion. The foot includes a first foot which is formed at the end of the first leg and extends outwardly horizontally therefrom. The first foot has a top surface and a bottom surface. A second foot is formed at the end of the second leg and extends horizontally outwardly therefrom. The second foot also has a top surface and a bottom surface. The bottom surface of the first foot has a plurality of pin-like projections extending outwardly therefrom. The bottom surface of the second foot also has a plurality of pin-like projections extending outwardly therefrom. The top surface and the bottom surface are in parallel relationship to each other.

The central body portion has a generally rectangular cross-section in a plane aligned with the beam. The beam is integrally formed with the central body portion so as to extend across this rectangular cross-section. The beam has a waveform pattern formed along the top surface of the beam. The beam has a rectangular cross-section in a plane parallel to the plurality of leg members. The beam has a height which is approximately twice a thickness of the beam. The beam is a longitudinal member having a male connector formed at one end and a female connector formed at an opposite end. The male connector is of a conical configuration suitable for receipt within a female connector, of frustoconical configuration, of an adjacent beam. The female connector has a conical interior opening extending so as to narrow at a bottom of the female connector. The conical male connector has a configuration suitable for mating receipt within the conical interior of the female connector. A slot is formed in the female connector such that the beam of the male connector can extend therethrough in alignment with the beam extending from the female connector. The slot is formed adjacent the top of the female connector approximately 180° from the beam.

In the present invention, the plurality of leg members and the beam are integrally formed of a polymeric material.

DETAILED DESCRIPTION OF THE INVENTION

Figures 1, 2, 3, 4, 5:
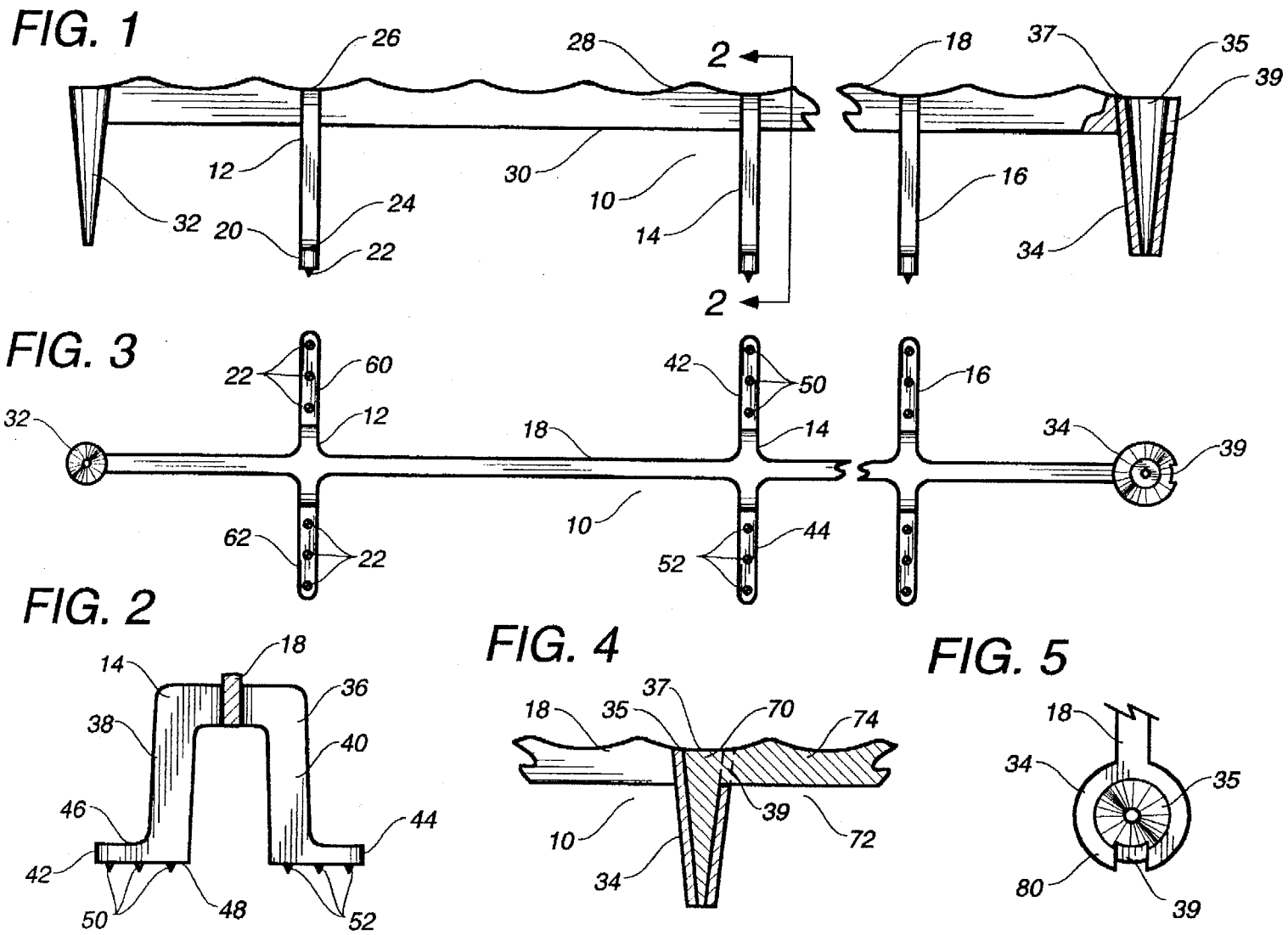
FIG. 1 is a side elevational view in partial cross-section of the bolster in accordance with the preferred embodiment of the present invention.
FIG. 2 is a cross-sectional view taken across lines 2—2 of FIG. 1.
FIG. 3 is a bottom view of the bolster in accordance with the preferred embodiment of the present invention.
FIG. 4 is an isolated view showing the interconnection of the female connector with a male connector of an adjacent bolster.
FIG. 5 is a plan view of the female connector of the bolster of the present invention.

Referring to FIG. 1, there is shown at 10 the bolster in accordance with the preferred embodiment of the present invention. The bolster 10 includes a plurality of leg members 12, 14 and 16 which are arranged in parallel spaced apart relationship. A beam 18 is integrally formed with the plurality of the leg members 12, 14, and 16 and extends transversely across these leg members.

In FIG. 1, it can be seen that the leg member 12 includes a bottom surface 20 and a pin-like projection 22 extending downwardly therefrom. The pin-like projection 22 extends downwardly from the bottom surface 20 so as to engage in underlying surface, such as a deck. The use of the pin-like projections 24 greatly enhances the strength of the leg members 22 since much of the strong supporting force of the leg members 12 is transferred, through the pin-like projections 22, to the underlying surface. The use of such pin-like projections 22 resists deformation of the leg members when a load is placed upon the beam 18. As used herein, the term pin-like projections refers to such projections in the form of pins, inverse pyramidal projections, or similar projections which can "bite" into an underlying surface.

In FIG. 1, it can be seen that the leg member 12 extends upwardly from the bottom surface 20 so as to receive the beam 18 therein. A top surface 24 is formed opposite the bottom surface 20 as part of the foot of the leg member 12. The top 26 of the leg member 12 is adjacent to the top surface 28 of the beam 18. Each of the legs 12, 14, and 16 has a similar configuration. The legs 12, 14, and 16 are generally evenly spaced along the length of the beam 18.

The beam 18 has a waveform pattern formed along the top surface 28 of beam 18. This waveform pattern 28 is suitable for the receipt of rebar therein. These "waves" act as a receiving area for such materials. The beam 18 has a flat bottom surface 30.

As can be seen, the beam 18 is a longitudinal member that has a male connector 32 at one end and a female connector 34 at the opposite end. The male connector 32 is suitable for receipt within a female connector (such as 34) of an adjacent beam. In normal use, this configuration of male connector 32 and female connector 34 allows several of the bolsters 10 to be connected to one another in end-to-end relationship. As such, the bolsters 10 can be connected to one another without the need for wiring together.

FIG. 2 illustrates, with particularity, the leg member 14. It can be seen that the leg member 14 includes a central body portion 36, a first leg 38, a second leg 40, a first foot 42, and a second foot 44. The first leg 38 extends downwardly from one side of the central body portion 36. The second leg 40 also extends downwardly from an opposite side of the central body portion 36. The foot 42 is formed at an end of the first leg 38 opposite the central body portion 14. Similarly, the foot 44 is formed at an end of the second leg 40 opposite the central body portion 16. The first foot 42 extends horizontally outwardly from the first leg 38. The second foot 44 also extends horizontally outwardly from the second leg 40. It can be seen that the first foot 42 has a top surface 46 and a bottom surface 48. The top surface 46 is in parallel relationship to the bottom surface 48. In normal use, the top surface 46 should be spaced from the bottom surface 48 by no more than ¼ inch. As such, this horizontally outwardly extending foot 42 facilitates the ability to staple the leg member 14 to an underlying surface, such as a deck. The pin-like projections 50 extend outwardly from the bottom surface 48 of the foot 42. The second foot 44 and the projections 52 have a similar configuration to that of the first foot 42. As such, the leg member 44, of the present invention, facilitates the ability to properly staple the leg member 14 to the underlying surface. In FIG. 2, it can be seen that the beam extends transversely across the central body portion 36. The central body portion 36 has a rectangular cross-section at the intersection with the beam 18. The beam 18 will similarly have rectangular cross-section in a plane parallel to the plurality of leg members. It can be seen in FIG. 2 that the beam 18 has a height which is approximately twice the thickness of the beam. As can be seen in FIG. 2, the beam 18 has a height of approximately 0.4 inches and a thickness of approximately 0.2 inches. This relation of height to thickness enhances the load-bearing capacity of the beam 18. As such, although the bolster 18 is made of a polymeric material, the sizes and dimensions enhance the strength and stability of the bolster 10. In FIG. 2, it can be seen that when a load is placed upon the beam 18, the projections 50 and 52 will tend to resist any deformation by the legs 38 and 40. The projections 50 and 52 will serve to "bite" into the underlying surface so as to resist such deformation. Since the beam 18 is integrally formed, through an injection molding process, with the leg member 14, the configuration of the present invention eliminates the need for welding or mechanical attachment techniques.

In FIG. 3, it can be seen that the beam. 18 is a longitudinal member which extends for the length of the bolster 10. The first leg member 12 extends outwardly transverse to the beam 18. The first leg member 12 includes a foot 60 on one side of the beam 18 and a foot 62 on an Opposite side of the beam 18. Projections 22 extend outwardly from the bottom surfaces of the feet 60 and 62. In the embodiment of the present invention shown in FIG. 3, a total of three pin-like projections 22 extend outwardly from the bottom surface of the feet 60 and 62. It is possible for fewer projections or more projections to be incorporated onto the feet 60 and 62. Similarly, the leg member 14 has a first foot 42 and a second foot 44 extending transversely outwardly of the beam 18. The projections 50 and 52 are shown as extending outwardly of the feet 42 and 44, respectively. The leg member 16 has a similar configuration to that of the leg members 12 and 14.

It can be seen in FIG. 3 that the leg members 12, 14, and 16 are arranged in plane parallel relationship to each other.

Importantly, in FIG. 3, it can be seen that the beam 18 has a conical male connector 32 at one end and a frustoconical female connector 34 at an opposite end. The male connector 32 has a length approximately equal to the height of the bolster 10. The male connector 32 is integrally formed with the beam 18. The conical male connector 32 extends and tapers downwardly so as to have a narrow end aligned with the feet of the bolster 10.

With reference to FIGS. 1 and 3, it can be seen that the female connector 34 has e generally frustoconical configuration. The female connector 34 includes an interior passage 35 of a conical configuration, generally matching the conical configuration of the male connector 32. This interior passage 35 opens at the top 37 of the female connector 34 so as to allow for the easy receipt of a male connector from an adjacent bolster. A slot 39 is formed in the female connector 34 adjacent to the top 37. The slot 39 allows the beam of an adjacent bolster to extend through the slot after the male connector is received within the interior passage 35. The slot 39 is positioned approximately 180° from the beam 18. By inserting the adjacent bolster into the female connector proper longitudinal alignment is assured between the beam of an adjacent bolster and the beam 18 of bolster 10. As a result, lengthy bolster arrangements can be achieved by joining separate bolsters in this manner.

FIG. 4 illustrates the manner in which a male connector 70 of an adjacent bolster 72 is received within the female connector 34 of bolster 10. As can be seen, the male connector 70 is of a conical configuration similar to that of the male connector of the bolster 10. The male connector 70 is inserted into the interior passage 35 of the female connector 34. The beam 74 of the bolster 72 is connected to the male connector 70 and extends through the slot 39 of the female connector 34. The top of the male connector 70 is generally aligned with the top 37 of the female connector 34. Beam 18 extends outwardly from the female connector 34. In the configuration illustrated in FIG. 4, the beam 74 will be longitudinally aligned with the beam 18. This arrangement of male/female connectors facilitates the ease of assembly and installation. It is only necessary to insert the male connector 70 into the female connector 34, rotate the beam 74 until it is received within the slot 39 and then press the male connector 70 so it resides within the passage 35 of the female connector 34. The frictional engagement between the male connector 70 and the female connector 34 assures a solid connection between the bolster 72 and the bolster 10.

FIG. 5 is a top view of the female connector 34. It can be seen that the female connector 34 has beam 18 extending outwardly therefrom. The top of the female connector 34 has a circular configuration. The slot 39 is formed in one of the walls of the female connector 34 so as to communicate between the interior passage 35 and the exterior 80 of the female connector 34. The interior passage 35 will taper downwardly in a conical manner.

The bolster 10 of the present invention greatly facilitates the installation and use of such bolsters at the construction site. Since each of the bolsters includes male/female connectors, it is a relatively easy process to connect such bolsters in end-to-end relationship. Since the present invention is manufactured through an injection-molding process, each of the bolsters 10 is relatively inexpensive and corrosion-proof in comparison with conventional metal bolsters. The use of such plastic bolsters eliminates the problems of corrosion or discoloring that can occur through the use of such metal bolsters. The use of the projections at the bottom of the feet and the dimensioning of the beam and leg members greatly enhances the strength of the bolster system. The configuration of the feet allows the bolster to be stapled to the deck during the installation process.

The foregoing disclosure and description of the invention is illustrative and explanatory thereof. Various changes in the details of the illustrated configuration can be made within the scope of the appended claims without departing from the true spirit of the invention. The present invention should only be limited by the following claims and their legal equivalents.

I claim:

1. A bolster for use in construction comprising:

a plurality of leg members arranged in parallel spaced relationship, each of said plurality of leg members having a foot means extending outwardly therefrom for contacting an underlying surface, each of said plurality of leg members comprising:

a central body portion;

a first leg extending downwardly from one side of said central body portion; and a second leg extending downwardly from an opposite side of said central body portion, said foot means formed on an end of said first and second legs opposite said central body portion, said second leg being in planar alignment with said first leg, said foot means comprising:

a first foot formed at the end of said first leg and extending horizontally outwardly therefrom, said first foot having a top surface and a bottom surface; and a second foot formed at the end of said second leg and extending horizontally outwardly therefrom, said second foot having a top surface and a bottom surface, said top surface and said bottom surface of said first foot being in parallel relationship, said top surface of said first foot spaced from said bottom surface of said first foot by no more than one-quarter inch; and a beam integrally formed with said plurality of leg members, said beam extending transversely across said plurality of leg members.

2. The bolster of claim 1, said bottom surface of said first foot having a plurality of pin-like projections extending outwardly therefrom, said bottom surface of said second foot having a plurality of pin-like projections extending outwardly therefrom.

3. The bolster of claim 1, said central body portion having a generally rectangular cross-section in a plane aligned with said beam.

4. The bolster of claim 3, said beam being integrally formed with said central body portion so as to extend across said rectangular cross-section.

5. The bolster of claim 1, said beam having a waveform pattern formed along a top surface of said beam.

6. The bolster of claim 1, said beam having a rectangular cross-section and a plane parallel to said plurality of leg members.

7. The bolster of claim 6, said beam having a height which is approximately twice a thickness of said beam.

8. The bolster of claim 1, said beam being a longitudinal member having a male connector formed at one end and a female connector formed at an opposite end, said male connector suitable for snap-fit receipt within a female connector of an adjacent beam.

9. The bolster of claim 8, said female connector having a conical interior passage, said male connector having a conical configuration tapering and narrowing downwardly from said beam.

10. The bolster of claim 9, said female connector having a slot therein, said slot extending from said conical interior passage to an exterior of said female connector, said slot positioned approximately 180° from said beam, said slot for receiving an adjacent beam.

11. The bolster of claim 1, said plurality of leg members and said beam being formed of a polymeric material.

12. A bolster for use in construction comprising:

a plurality of leg members; and a beam affixed to and extending across said plurality of leg members, said beam being a longitudinal member having a male connector formed at one end and a female connector formed at an opposite end, said male connector suitable for receipt within a female connector of an adjacent beam, said female connector having a conical interior passage, said male connector having a conical configuration tapering and narrowing downwardly from said beam, said female connector having a slot therein, said slot extending from said conical interior passage to an exterior of said female connector, said slot positioned approximately 180° from said beam, said slot for receiving an adjacent beam in longitudinal alignment with said beam.

13. The bolster of claim 12, said plurality of leg members and said beam being integrally formed together of a polymeric material.

* * * * *